US012258535B2

(12) United States Patent
Golden

(10) Patent No.: US 12,258,535 B2
(45) Date of Patent: Mar. 25, 2025

(54) EMULSIONS HAVING OIL PHASE SURFACTANTS AND WATER PHASE ADDITIVE BLENDS

(71) Applicant: Pilot Chemical Corp., Cincinnati, OH (US)

(72) Inventor: Robert E. Golden, Wyoming, OH (US)

(73) Assignee: Pilot Chemical Corp., West Chester, OH (US)

( * ) Notice: Subject to any disclaimer, the term of this patent is extended or adjusted under 35 U.S.C. 154(b) by 0 days.

(21) Appl. No.: 16/146,570

(22) Filed: Sep. 28, 2018

(65) Prior Publication Data

US 2019/0100715 A1 Apr. 4, 2019

Related U.S. Application Data

(60) Provisional application No. 62/641,743, filed on Mar. 12, 2018, provisional application No. 62/565,707, filed on Sep. 29, 2017.

(51) Int. Cl.
*C10M 173/00* (2006.01)
*C10M 133/08* (2006.01)
(Continued)

(52) U.S. Cl.
CPC ..... *C10M 173/00* (2013.01); *C10M 133/08* (2013.01); *C10M 133/16* (2013.01); *C10M 135/10* (2013.01); *C10M 141/08* (2013.01); *C10M 2201/02* (2013.01); *C10M 2201/083* (2013.01); *C10M 2203/003* (2013.01); *C10M 2207/022* (2013.01); *C10M 2207/126* (2013.01); *C10M 2207/127* (2013.01); *C10M 2207/282* (2013.01); *C10M 2215/04* (2013.01); *C10M 2215/042* (2013.01); *C10M 2215/082* (2013.01); *C10M 2215/26* (2013.01); *C10M 2215/28* (2013.01); *C10M 2219/042* (2013.01); *C10M 2219/044* (2013.01); *C10M 2223/04* (2013.01); *C10M 2227/061* (2013.01); *C10N 2030/06* (2013.01); *C10N 2030/12* (2013.01); *C10N 2030/16* (2013.01); *C10N 2030/24* (2020.05);
(Continued)

(58) Field of Classification Search
CPC ..... C10M 2201/02; C10M 2215/28; C10M 2215/26; C10M 2219/044; C10M 2203/003; C10N 2030/24; C10N 2030/12; C10N 2040/20
See application file for complete search history.

(56) References Cited

U.S. PATENT DOCUMENTS 4,146,499 A 3/1979 Rosano
4,149,983 A * 4/1979 Grier ..... C10M 173/00 252/77
(Continued)

OTHER PUBLICATIONS

Thomas, Shane; International Search Report and Written Opinion of the International Searching Authority, issued in International Application No. PCT/US2018/053491; Nov. 29, 2018; 8 pages.

*Primary Examiner* — Vishal V Vasisth
(74) *Attorney, Agent, or Firm* — Frost Brown Todd LLP

(57) ABSTRACT

Emulsions including an additized oil phase and a water phase additive blend are disclosed. The components of the additized oil phase and the water phase additive blend do not interact. The emulsions are useful as metalworking fluids. Methods of making and using the emulsions are also disclosed.

19 Claims, 5 Drawing Sheets

(51) Int. Cl.

| | |
|---|---|
| ***C10M 133/16*** | (2006.01) |
| ***C10M 135/10*** | (2006.01) |
| ***C10M 141/08*** | (2006.01) |
| *C10N 30/00* | (2006.01) |
| *C10N 30/06* | (2006.01) |
| *C10N 30/12* | (2006.01) |
| *C10N 30/16* | (2006.01) |
| *C10N 40/20* | (2006.01) |
| *C10N 50/00* | (2006.01) |

(52) U.S. Cl.
CPC .... *C10N 2040/20* (2013.01); *C10N 2050/011* (2020.05)

(56) References Cited

U.S. PATENT DOCUMENTS

| | | | | |
|---|---|---|---|---|
| 4,781,848 | A | 11/1988 | Biresaw et al. | |
| 4,806,256 | A * | 2/1989 | Rose | C10M 171/00 252/71 |
| 5,942,216 | A | 8/1999 | Herb et al. | |
| 2005/0245650 | A1 | 11/2005 | Deroo et al. | |
| 2009/0036338 | A1 | 2/2009 | Hee et al. | |

* cited by examiner

EXAMPLE 7 EXAMPLE 8 EXAMPLE 9

EMULSIONS HAVING OIL PHASE SURFACTANTS AND WATER PHASE ADDITIVE BLENDS

CROSS REFERENCE TO RELATED APPLICATIONS

The present application claims the priority of U.S. provisional application Ser. No. 62/641,743, entitled EMULSIONS HAVING OIL PHASE SURFACTANTS AND WATER PHASE ADDITIVE BLENDS, filed Mar. 12, 2018, and the priority of U.S. provisional application Ser. No. 62/565,707, entitled EMULSIONS HAVING OIL PHASE AND WATER PHASE SURFACTANTS, filed Sep. 29, 2017, and hereby incorporates each application herein by reference in their respective entireties.

BACKGROUND

Whenever metal is machined or worked, processes such as lubrication, heat removal, and chip removal are required. Use of a metalworking fluid can provide such benefits and can allow metal to be reliably worked. Additionally, use of metalworking fluids can extend the life of the machining tool and improve the finish of a part. Known metalworking fluids are oil in water emulsions which exhibit the benefits of both oil and water. For instance, known metalworking fluids typically include additized oils which improve the lubricant performance of the oil. The additized oils include additives for lubricity, enhanced extreme pressure and anti-wear performance, and corrosion inhibition. Water, which has high heat capacity and heat transfer characteristics, is included to remove heat. Surfactants to stabilize the metalworking fluids are included only in the oil phase of the metalworking fluid.

DETAILED DESCRIPTION

Figure 1:
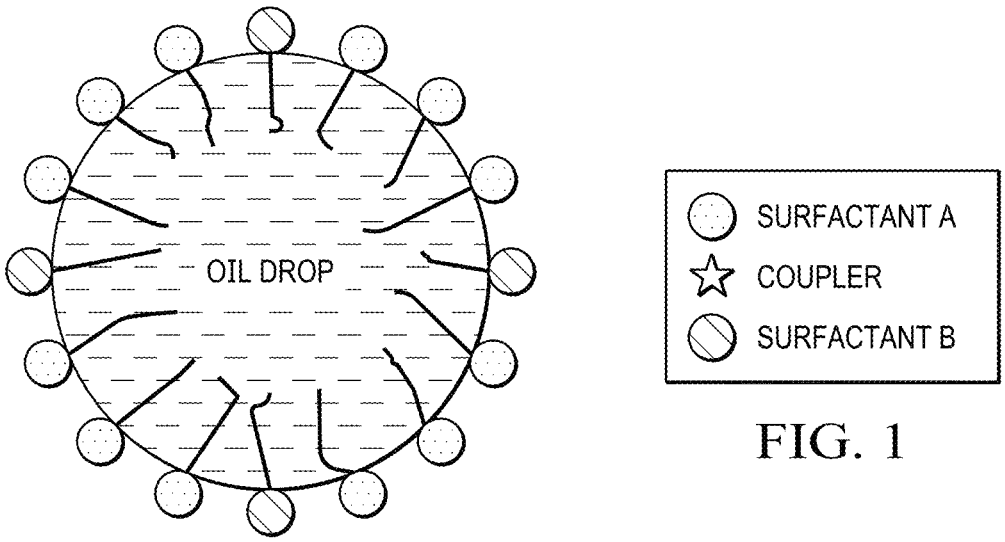
FIG. 1 depicts a representation of an oil droplet stabilized by oil phase surfactants and couplers immobilized at the oil-water interface.

Emulsions, either oil in water or water in oil, are useful to perform many tasks. For instance, certain oil in water emulsions can be useful metalworking fluids and can be useful to provide lubrication, heat removal, and chip removal while working, or machining, metals. As used herein, "emulsion" refers to both micro emulsions and macro emulsions. As used herein, "micro emulsion" includes nanometer sized drops of oil dispersed in water or water dispersed in oil.

As can be appreciated, it is desirable to enhance emulsions, such as metalworking fluids, through the inclusion of additives. For metalworking fluids, such additives are typically dispersed in the oil phase because many additives are oil soluble and because, in combination with properly formulated emulsifiers, a premixed oil phase concentrate can be formed. The oil phase concentrate can be added to oil to produce a suitable oil cut which can then be mixed with water to form a final metalworking fluid emulsion. Consequently, a single product can be sold and a usable metalworking fluid emulsion can be easily formed.

Known metalworking fluids are sensitive to a variety of factors including salinity, multivalent cations such as calcium ions, temperature, microbial growth, debris, and contamination. As can be appreciated, only some of these factors can be addressed through remediation. For example, filtration, skimming, antimicrobials, and make-up fluid can only partially mitigate issues relating to microbial growth, debris, and contamination, but cannot mitigate increasing salinity and the buildup of multivalent cations. As can be appreciated, once an emulsion, such as a metalworking fluid, breaks, it cannot be reformed and must be disposed of. Known oil phase additives have had limited success in increasing the tolerance of metalworking fluids to salinity and multivalent cations.

It has been unexpectedly discovered that a water phase additive blend can be added to the water phase of an emulsion without affecting either emulsion formation or emulsion stability. For oil in water emulsions, a water phase additive blend can be added to the water phase either before formation of the emulsion or after formation of the emulsion. It has been further discovered that such a water phase additive blend does not interact with the components in the oil phase and can be "incompatible" with the oil phase additives and surfactants. As used herein, incompatible means a component that undergoes one or more chemical or physical reactions. In certain embodiments, the water phase additive blend includes one or more components which are added to the water phase of an emulsion and which do not migrate to the oil phase. In certain embodiments, a water phase additive blend means a mixture of one or more of the following: surfactants, biological regulating agents, chelating agents, lubricity agents, biocides and/or corrosion inhibitors. As used herein, surfactants means compounds, or mixtures of compounds, that are surface active. Suitable surfactants are typically amphiphilic molecules and include anionic surfactants, cationic surfactants, amphoteric surfactants (betaine-type), and non-ionic surfactants.

Prior to the present discovery, it was believed that additives to an emulsion, regardless of the phase they originated in, were expected to interact with each other. For example, it was believed that surfactants would migrate to the water-oil interface where they would interact with any other surfactants included in the emulsion which also would have migrated to the water-oil interface. Any disruption of the carefully balanced set of surfactants, alkalinity agents and couplers would result in the formation of an unstable emulsion.

It has instead been found that metalworking fluids do not conform to this understanding of emulsions. Instead, it is theorized that metalworking fluids are structured fluids as evidenced by the observation that oil-soluble surfactants must be in the oil phase prior to the formation of the emulsion. Specifically, it has been observed that oil phase surfactants added to the water phase cannot form an emulsion suggesting that such surfactants cannot migrate between the phases as predicted by earlier emulsion theories. Without being bound by theory, it is instead believed that certain additives (e.g., surfactants) form a low energy state at the oil-water interface and have a large kinetic barrier to prevent their mobility once located at the interface.

Under this emulsion theory, it is theorized that an emulsion formed using an additized oil phase have oil droplets stabilized by oil phase surfactants and couplers that do not migrate out of the oil phase as depicted in FIG. 1. This model does not predict that surfactants have a defined curvature (as predicted in the HLD-NAC model) and instead predicts that the oil droplets are stabilized in a low energy arrangement determined by the particular combination and concentration of surfactants and couplers. For slight variances, the bulk of the oil phase will be in the low energy arrangement with any remaining oil resulting in slight creaming (observed as an oil rich phase in the emulsion).

Figure 2:
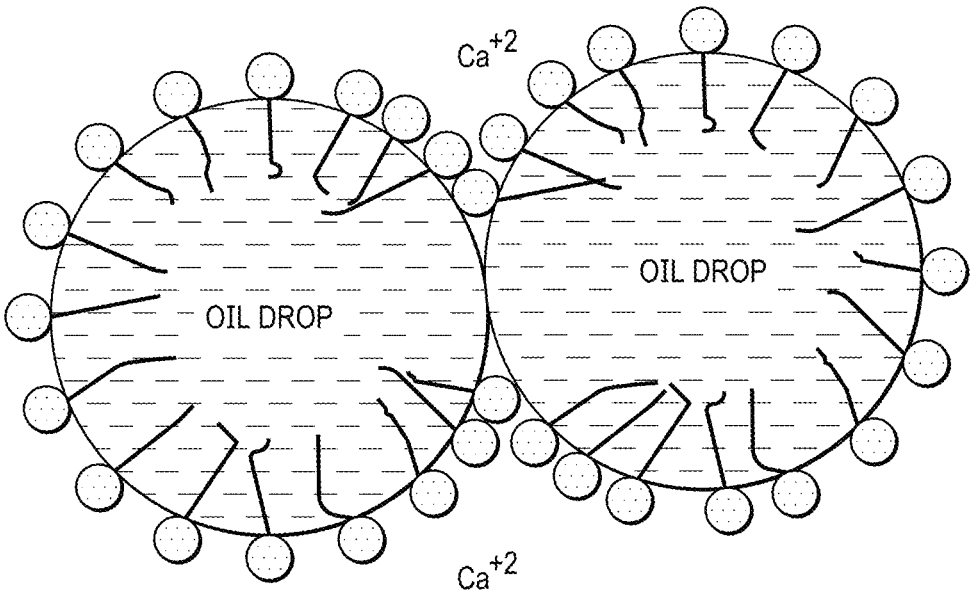
FIG. 2 depicts a representation of calcium cations attracting oil droplets together.

This theorized model provides a theory for why multivalent ions break the emulsion. In the model, multivalent ions, such as calcium ions, can act as an adhesive to form a loose association between oil droplets resulting in flocculation. This flocculation causes an apparent increase in particle size viewable in the aggregate emulsion as a decrease in transparency. As the concentration of multivalent ions increases, the associations between oil droplets increase to an average density low enough to cause oil droplets to cream out of the emulsion. Finally, as the multivalent ion concentration increases further, oil droplets are pulled together as generally depicted in FIG. 2. As can be appreciated, this theory matches well with empirical observations which observe the formation, and separation from oil, of lime soap at the breakdown of the emulsion. This theory also predicts similar effects for single valent ions such as sodium.

It is believed that a water phase additive blend can be added to the water phase because the components of the water phase additive blend will not migrate to the oil phase under the theory presented herein. Instead, such components will remain dissolved in the water phase.

Figure 3:
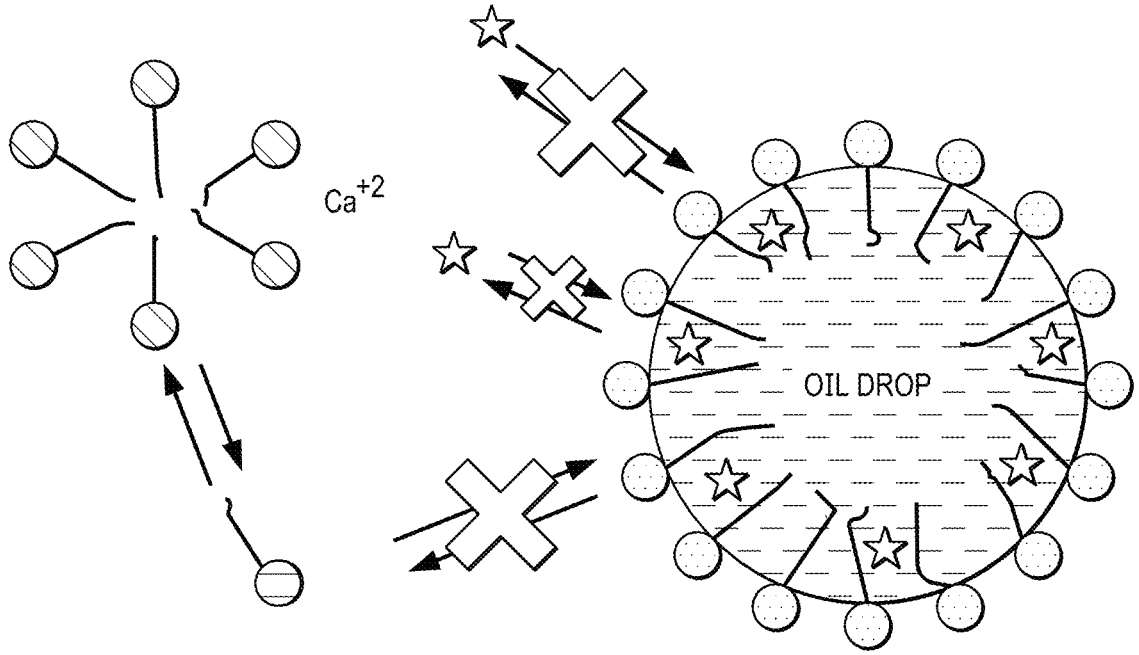
FIG. 3 depicts a representation of water phase additives stabilizing calcium cations.

Specific water phase additive blends are contemplated with each of the additives in the blend including one or more components to mitigate issues of an emulsion such as the presence of multivalent cations in a metalworking fluid emulsion. For example, FIG. 3 depicts an image illustrating how a water phase additive blend including surfactants and couplers (such as alkyl diphenyl oxide disulfonate surfactants) can stabilize calcium ions and can prevent such calcium ions from adhering oil droplets together. Such a water phase additive blend can increase the tolerance of a metalworking fluid to multivalent cation buildup.

As can be appreciated, the inclusion of a water phase additive blend to the water phase of an emulsion can allow various properties exhibited by the emulsion to be enhanced. For instance, certain metalworking fluid emulsions described herein including a water phase additive blend can exhibit increased tolerance to hard water; increased tolerance to salinity; exhibit improved lubricity; exhibit improved corrosion inhibition; improved microbial control; and maintain a suitable foam profile. As can be appreciated, the lifetime of a metalworking fluid emulsion can be improved because hard water cation build-up, microbial attack, and the appearance of flash corrosion can be addressed by specific water phase additive blends. As can be further appreciated, selection of certain water phase additive blends can impart other performance attribute improvements, such as extreme pressure performance and antiwear performance, and can allow for the creation of other beneficial emulsions.

In certain embodiments, the improved emulsions described herein can be formed by addition of a water phase additive blend to either new, or previously known, emulsions. For example, improved metalworking fluid emulsions can be formed through the addition of a water phase additive blend, including components such as surfactants, to a previously known metalworking fluid emulsion including additives only in the oil phase.

In certain embodiments, a water phase additive blend can include one or more surfactants. In certain such embodiments, the one or more surfactants can include an alkyl diphenyl oxide disulfonate. In certain embodiments, a water phase additive blend can include components to resist multivalent cations and salinity, resist biological contaminants, resist corrosion, and improve lubricity. For example, a suitable water phase additive blend exhibiting such properties can include a surfactant such as an alkyl diphenyl oxide disulfonate, a quaternary ammonium, an amine carboxylate, and an amide.

In certain embodiments, the water phase additive blend can be added to the water phase prior to the formation of the emulsion. In other certain embodiments, a water phase additive blend can be added to a previously formed emulsion. For example, a water phase additive blend including a surfactant and an amine carboxylate can be added to an emulsion after flash corrosion is observed. Such water phase additive blends can be the first water phase additive blend added to an emulsion or can be a supplementary water phase additive blend. In certain embodiments, the water phase additive blend can be added to a metalworking fluid without requiring the fluid to be removed from the metalworking machine.

Generally, the emulsions described herein can be useful as metalworking fluids and can include a water phase additive blend. The water phase additive blend can improve the performance of existing metalworking fluids without reformulation of the oil phase; improve the performance of the metalworking fluid for hard water tolerance beyond levels normally achievable through modification of components in the oil phase; mitigate and recover performance attributes that degrade over time without replacing the metalworking fluid including the appearance of "flash corrosion"; significantly improve sump life; improve the health and environmental profile of metalworking fluids by reducing or eliminating the use of amines and biocides; and can allow the water phase to contribute to the lubricity and overall performance of the metalworking fluid.

Conventional Metalworking Fluid Emulsions

Conventional metalworking fluid emulsions are generally oil in water macro emulsions. When the drop sizes are small enough to be micro emulsions, metalworking fluids are known as semi-synthetic fluids. In either type of emulsion, the dispersed phase is formed of discrete drops of oil and the continuous phase is water. The improved emulsions described herein can improve either type of metalworking fluid through the addition of a water phase additive blend.

Generally, conventional metalworking fluid emulsions include an additized oil phase which includes all of the surfactants and additives necessary to form a conventional metalworking fluid emulsion. Suitable components of an additized oil phase can generally include one or more of: an oil, oil soluble surfactants, secondary emulsifiers, alkalinity agents, couplers, and performance additives such as extended performance/anti-wear additives, lubricity agents, corrosion inhibitors, biocides, and antifoam agents. In certain embodiments, suitable additized oil phases can be commercially obtained. For example, additized oil phases including sodium sulfonate, fatty acid soaps, glycols, chlorinated paraffins, and a petroleum based oil, such as, Trim Sol™, a cutting and grinding fluid manufactured by Master Chemical of Perrysburg, Ohio, can provide a suitable additized oil phase for the improved emulsions described herein.

As can be appreciated, mixing of a conventional additized oil phase with water produces a conventional metalworking fluid emulsion. By weight, metalworking fluids can include about 5% to about 15%, by weight, of the additized oil phase with the remainder of the metalworking fluid being water. The improved metalworking fluid emulsions described herein can be formed by modifying the water phase of the conventional metalworking fluid emulsions with one or more water phase additive blends. In certain embodiments, the additized oil phase is substantially unmodified. In certain embodiments, the additized oil phase is unmodified.

In certain embodiments, the additized oil phase can alternatively be modified based on the capabilities of a water phase additive blend. For example, in certain embodiments, the use of a water phase additive blend can reduce, or eliminate, the need to use a corrosion inhibitor in the additized oil phase. In such embodiments, the additized oil phase can include less, or can be substantially free of, amides and amines. Such additized oil phases can instead include, for example, potassium carboxylate and glycols as replacements to amine carboxylate and triethanolamine respectively. The water phase additive blend in such embodiments can include water phase corrosion inhibitors. Suitable water phase corrosion inhibitors include one or more of sodium nitrite and alkali metal carboxylates. The water phase corrosion inhibitors can be amine free.

Suitable oils for the additized oil phase of a conventional metalworking fluid emulsion can generally include any oils that are immiscible with water. For example, suitable oils can include mineral oils, polyalphaolefin oils, vegetable oils, silicone oils, and alkylaromatic oils. In certain embodiments, the oil can advantageously be a mineral oil.

One or more emulsifiers are included in the additized oil phase to stabilize the metalworking fluid emulsion. As can be appreciated, emulsifiers, such as surfactants, are necessary to allow a stable emulsion to be formed. Generally, suitable emulsifiers can include a blend of surfactants that, as a system, are soluble in the oil. For example, the additized oil phase can include primary surfactants, secondary emulsifiers, and couplers in certain embodiments. In certain embodiments, suitable primary surfactants can include natural or synthetic petroleum sulfonates, which are soluble by themselves in oil, yet may only disperse in water. Natural sulfonates are derived by the sulfonation of mineral oils, while synthetic petroleum sulfonates are sulfonated alkyl aromatics, which are typically blends of several feedstocks.

In certain embodiments, the emulsifier system can include secondary emulsifier surfactants. For example, suitable secondary emulsifier surfactants can include long chained fatty acids, alkyl sulfates, alkoxylated nonionics, alkoxylate carboxylates, and other surfactants known in the art. In certain embodiments, long chained fatty acids derived from tall oil can be particularly advantageous. The low rosin tall oil fatty acids are a mixture of primarily oleic and linoleic acids. Oleic acid can be a surrogate for the tall oil fatty acid.

In certain embodiments, an additized oil phase can further include couplers. Couplers are non-amphiphilic compounds that have polar functional groups but have an insufficiently large hydrophobic group to function as a surfactant by itself. Suitable couplers for an additized oil phase can include diethylene glycol and hexylene glycol. As can be appreciated, triethanolamine, which is also an alkalinity agent, can also act as a coupler.

As can be appreciated, emulsifier systems including multiple surfactants can allow the conventional metalworking fluid emulsions to balance multiple properties. For example, the inclusion of secondary emulsifier surfactants and couplers can offset the limited hard water tolerance of emulsions including only sulfonate surfactants.

In certain embodiments, alkalinity agents can be included in the additized oil phase to neutralize the acidity of any acidic emulsifiers and to adjust the pH of the metalworking fluid. As can be appreciated, it can be desirable for metalworking fluids to be alkaline to facilitate the use of the fluids with ferrous parts which would oxide under acidic conditions. In certain embodiments, the pH of a metalworking fluid can be about 7 to about 13, in certain embodiments, about 8 to about 12, and, in certain embodiments, about 8 to about 10. In embodiments including fatty acids, suitable alkalinity agents can include potassium hydroxide and amines. For example, triethanolamine can be a useful alkalinity agent in certain embodiments. As can be appreciated however, metalworking fluids can also be formed which do not need an alkaline pH such as when, for example, the metalworking fluid is intended for use with non-ferrous parts and machinery.

As can be appreciated, other additives can be formulated into the additized oil phase, or oil cut, to impart other desirable properties such as corrosion inhibition, increased lubricity, increased extreme pressure performance, increased anti-wear performance, hard water tolerance, antimicrobial properties, and/or antifoam properties. The additized oil phase can also contain other additives that would enhance the aesthetics of the metalworking fluid including additives to mask olfactory smells and colorants such as dyes and pigments. Such additives are generally known in the art.

In certain embodiments, suitable oil phase corrosion inhibitors can include oil soluble sulfonates, and amine carboxylates such as di-carboxylates and amides. As can be appreciated however, certain oil phase corrosion inhibitors can also act as an emulsifier. For example, oil soluble sulfonates can act as both a corrosion inhibitor and as a surfactant for an oil phase. Amine carboxylates and amides can also exhibit surfactant properties. As can be appreciated, the inclusion of corrosion inhibitors exhibiting surfactant properties can require rebalancing of the surfactants. Amines can also function as a corrosion inhibitor. As can be appreciated, amines are polar enough to have similar effects to couplers and can also necessitate adjustment to the surfactant system when included. As can be appreciated however, inclusion of a corrosion inhibitor in a water phase additive blend of an improved emulsion as described herein can obviate the need to rebalance the oil phase emulsion system and can eliminate the need to include an oil phase corrosion inhibitor. In certain embodiments, the emulsions described herein can be substantially free of an oil phase corrosion inhibitor. In certain embodiments, the emulsions described herein can be free of an oil phase corrosion inhibitor.

As used herein, "oil phase corrosion inhibitor" means a corrosion inhibitor added to oil prior to the formation of a metalworking fluid. As used herein, "water phase corrosion inhibitor" means a corrosion inhibitor added to the water phase either prior to formation of the metalworking fluid or added to an already formed metalworking fluid.

Historically, additized oil phases could also include chelating agents to improve the hard water tolerance of a metalworking fluid by chelating multivalent cations such as calcium ions. As used herein, "chelating agent" means a compound capable of coordinating to a metal or metal salt. For example, ethylenediaminetetraacetic acid ("EDTA") was included in additized oil phases to increase tolerance of emulsions to hard water. As can be appreciated however, chelating agents have a number of negative attributes. For example, chelating agents can increase the salinity of a system. Such increases in salinity can negatively affect the emulsion stability. Furthermore, certain chelating compounds can also have a deleterious health effect. Advantageously, the emulsions described herein can exhibit resistance to multivalent cations without the use of chelating agents and, in certain embodiments; the emulsions described herein can be substantially free of any chelating agents.

In embodiments including a chelating agent, suitable chelating agents can include the acid, organic salt form, or alkali metal salt form of: 1,1,1-Trifluoroacetylacetone, 2,2'-Bipyrimidine, Acetylacetone, Alizarin, Amidoxime, Aminoethylethanolamine, Aminomethylphosphonic acid, Aminopolycarboxylic acid, Benzotriazole, Bipyridine, 2,2'-Bipyridine, Bis(dicyclohexylphosphino)ethane, 1,2-Bis(dimethylarsino)benzene, 1,2-Bis(dimethylphosphino)ethane, 1,2-Bis(diphenylphosphino)ethane, Calixarene, Carcerand, Catechol, Cavitand, Citrate, Citric acid, Clathrochelate, Corrole, Cryptand, 2,2,2-Cryptand, Cyclam, Cyclodextrin, Trans-1,2-Diaminocyclohexane, 1,2-Diaminopropane, 1,5-Diaza-3,7-diphosphacyclooctanes, 1,4-Diazacycloheptane, Dibenzoylmethane, Diethylenetriamine, Diglyme, 2,3-Dihydroxybenzoic acid, Dimercaprol, 2,3-Dimercapto-1-propanesulfonic acid, Dimercaptosuccinic acid, 1,1-Dimethylethylenediamine, 1,2-Dimethylethylenediamine, Dimethylglyoxime, Diphenylethylenediamine, 1,5-Dithiacyclooctane, Domoic acid, 1,2-Ethanedithiol, Ethylenediamine, Ethylenediaminediacetic acid, Ethylenediaminetetraacetic acid, Etidronic acid, Gallic acid, Gluconic acid, Glutamic acid, Glyoxal-bis(mesitylimine), Glyphosate, Hexafluoroacetylacetone, Homocitric acid, Iminodiacetic acid, Isosaccharinic acid, Kainic acid, Malic acid, Nitrilotriacetic acid, Oxalic acid, Oxime, Pendetide, Penicillamine, Pentetic acid, Phanephos, Phenanthroline, O-Phenylenediamine, Phosphonate, Phthalocyanine, Phytochelatin, Picolinic acid, Polyaspartic acid, Porphine, Porphyrin, 3-Pyridylnicotinamide, 4-Pyridylnicotinamide, Pyrogallol, Salicylic acid, Sarcophagine, Sodium citrate, Sodium diethyldithiocarbamate, Sodium polyaspartate, Terpyridine, Tetramethylethylenediamine, Tetraphenylporphyrin, Thenoyltrifluoroacetone, Thioglycolic acid, 1,4,7-Triazacyclononane, Tributyl phosphate, Triethylenetetramine, Trisodium citrate and 1,4,7-Trithiacyclononane.

Antifoam agents and defoamers can be included in certain embodiments. For example, antifoam agents can be added to the additized oil phase to mitigate foam formation. Defoamers can be added to the already formed emulsion to break existing foam. Generally, any antifoam agents and defoamers known in the art can be suitable.

In certain embodiments, extreme pressure agents can be included. Suitable extreme pressure agents can include amine or alkali metal salts to chlorinated carboxylates in certain embodiments.

Lubricity agents can be included in certain embodiments. Suitable lubricity agents can include C8-C20 alkyl amides or alkanolamides (e.g. tall oil fatty acid di-isopropanol amide (DIPA), cocamide DIPA, cocamide diethanolamide), C8-C24 Alkyl phosphate esters, C8-C20 linear or branched carboxylates (e.g. diethanolamine oleate; potassium oleate), polyol esters, and carboxylate esters.

Water Phase Additive Blends

The improved emulsions described herein include a water phase additive blend to enhance the properties of an emulsion. For example, in certain embodiments, the improved emulsions described herein can include an additized oil phase and a water phase additive blend.

A water phase additive blend can include surfactants in certain embodiments. For example, in certain embodiments, a water phase additive blend can include anionic surfactants to improve resistance to salinity and hard water. In such embodiments, an emulsion's resistance to hard water can be increased through inclusion of an anionic surfactant such as a sulfonated alkyl aromatic surfactant. Hard water tolerance is a term that reflects how sensitive an emulsion is toward multivalent cations such as calcium. Tolerance is measured by increasing the water hardness into which an emulsion is prepared and looking for signs of instability such as solids formation, creaming, or oil separation. Typically, the claim for hard water tolerance uses the highest calcium concentration in the water prior to the appearance of oil separation.

Certain anionic surfactants can stabilize an emulsion by forming a stable complex with calcium ions. In certain embodiments, suitable anionic surfactants can include amine, alkali metal or alkaline earth metal salts of: C6-C24 alkyl diphenyl oxide disulfonates, C8-C24 alkyl ether sulfates, C8-C24 alkyl sulfates, C8-C16 alkyl aromatic sulfonates, C10-C18 olefin sulfonates, C8-C24 carboxylates, C8-C24 phosphate mono and/or di-esters, sulfo-succinate mono or di-esters of C8-C24 linear or branched alcohols, or alcohol ethoxylates.

In certain embodiments, more specific suitable anionic surfactants can include Benzene, 1,1'-oxybis-, tetrapropylene derivatives, sulfonated, sodium salts; Benzenesulfonic acid, branched dodecyl(sulfophenoxy), disodium salt; Disodium oxybis(dodecylbenzenesulfonate); Di sodium dodecyl (sulfophenoxy) benzenesulfonate; Sodium dodecyl(phenoxy)-benzenesulfonate; Sodium oxybis(dodecylbenzene) sulfonate; Benzenesulfonic acid, branched dodecyl-, (branched dodecyl phenoxy), sodium salt; Benzenesulfonic acid, phenoxy, branched dodecyl-, sodium salt; Benzenesulfonic acid, oxybis(branched dodecyl-), disodium salt; Disodium oxybis(dodecylbenzenesulfonate); Disodium dodecyl(sulfophenoxy)-benzenesulfonate; Sodium dodecyl (phenoxy)-benzenesulfonate; Disodium dodecyl(sulfophenoxy) benzenesulfonate, C10 (Linear) Sodium Diphenyl Oxide Disulfonate, C16 (Linear) Sodium Diphenyl Oxide Disulfonate, C6 (Linear) Diphenyl Oxide Disulfonic Acid, C12 (Branched) Sodium Diphenyl Oxide Disulfonate, C12 (Branched) Diphenyl Oxide Disulfonic Acid, C12 (Branched) Diphenyl Oxide Disulfonic Acid, Sodium alkyl diphenyl oxide sulfonate; Sodium Alpha Olefin (C12) Sulfonate; Sodium Alpha Olefin 20 (C14-16) Sulfonate; Sodium Olefin Sulfonate; Sodium Linear Alkyl Benzene Sulfonate; Sodium Linear Alkyl Benzene Sulfonate; Linear Alkyl Benzene Sulfonic Acid; Linear Alkyl Benzene Sulfonic Acid; Sodium Oleic Sulfonate; Triethanolamine Linear Alkyl Benzene Sulfonate; Isopropylamine Branched Alkyl Benzene Sulfonate; Sodium Alpha Olefin Sulfonate; Sodium C14-16 alpha olefin sulfonate; Sodium Branched Dodecyl Benzene Sulfonate; Sodium Branched Alkyl Benzene Sulfonate; Branched Dodecyl Benzene Sulfonic Acid;

Sodium Linear Alkyl Benzene Sulfonate; Isopropylamine Branched Alkyl Benzene Sulfonate; and Isopropylamine Linear Alkyl Benzene Sulfonate.

In certain embodiments, an emulsion including an anionic surfactant in the water phase can be stable with a concentration of about 750 ppm, or more, of calcium, about 1,000 ppm, or more, of calcium, or about 1,500 ppm, or more, of calcium.

In certain embodiments, an anionic surfactant can also act as an additive enhancer and improve the performance of other components in the water phase additive blend. For example, in certain embodiments, alkyl diphenyl oxide disulfonates can improve the performance of quaternary ammonium compounds to reduce biological contamination and/or improve the lubricity of a metalworking fluid.

In certain embodiments, a water phase additive blend can further, or alternatively, include cationic surfactants. As can be appreciated, anionic surfactants and cationic surfactants are typically considered to be incompatible surfactants for an emulsion system because they react to form an insoluble complex. As a consequence, known metalworking fluids do not include cationic surfactants because the oil phase of such fluids typically include anionic surfactants. As presently discovered however, cationic surfactants in the water phase will not interact with the anionic surfactants in the oil phase.

In certain embodiments, inclusion of a cationic surfactant, such as a quaternary ammonium surfactant into the water phase, can allow the emulsions described herein to exhibit biological regulating properties. Known quaternary ammonium surfactants (sometimes referred to as "quaternary amine" compounds or "quat" compounds) exhibiting biological regulating properties can be particularly advantageous.

Suitable quaternary ammonium compounds can include: Benzalkonium chloride, benzethonium chloride, methylbenzethonium chloride, cetalkonium chloride, cetylpyridinium chloride, cetrimonium, cetrimide, dofanium chloride, tetraethylammonium bromide, domiphen bromide, Diquat-diquaternary ammonium, Carnitine, Cetyl trimethylammonium bromide (CTAB), stearalkonium chloride, Choline, Cocamidopropyl betaine (CAPB), Denatonium, Dimethyldioctadecylammonium chloride, Dioctadecyldimethylammonium bromide (DODAB), Paraquat, Polyquaternium, Quaternary ammonium, Silicone quaternary amines, Tetra-n-butylammonium bromide, Tetramethylammonium chloride, Tetramethylammonium hydroxide, and distearyldimethylammonium chloride. In certain embodiments, the quaternary ammonium compounds can provide disinfection (a greater than 3 log kill after 24 hours), can provide preservation (less than 3 log colony forming units ("CFU") after multiple challenges), or can provide sanitation (greater than 5 log kill). In certain embodiments, the quaternary ammonium compound can be a biocide.

In certain embodiments, inclusion of a biological regulating additive such as a cationic surfactant can reduce, or eliminate, the need to use biocides with damaging environmental or health profiles. For example, inclusion of biological regulating additives in a water phase additive blend can reduce, or eliminate, the need to use amines and biocides (e.g. orthophenylphenol).

In certain embodiments including both anionic surfactants and cationic surfactants in the water phase additive blend, the cationic surfactants and anionic surfactants can be included in an about 1 to about 10, or more, molar ratio. Such molar ratios can minimize any interaction caused by inclusion of both an anionic and cationic surfactant.

Water phase additive blends can include yet further components. For example, inclusion of an alkanoamide surfactant such as a diethanolamide can improve corrosion resistance. In certain embodiments, an example of a suitable diethanolamide is a modified cocamide diethanolamide. As can be appreciated, such surfactants can be particularly advantageous when the emulsion is a metalworking fluid. Metalworking fluids are used on a variety of metals, but the most common metals are iron-based alloys. The iron in these alloys tends to oxidize, or corrode, in the presence of water and air. Often a thin film from the metalworking fluid remains on the piece, and the corrosion inhibition depends on the ability of that film to protect the metal surface from the water/air mixture. Inclusion of a corrosion inhibitor in the water phase can facilitate the formation of emulsions which resist corrosion without any of the issues caused by including corrosion inhibitors in the oil phase.

Other suitable corrosion inhibiting agents for the water phase additive blends described herein can include amine carboxylates, amine or alkali metal salts of decyl dicarboxylic acid, amine or alkali metal salts of undecyl dicarboxylic acid, amine or alkali metal salts of azelic acid, amine borate esters, amine or alkali metal succinate esters, sodium nitrite, and ethoxylated amines. As can be appreciated, commercial corrosion inhibition agents such as Corefree® M-1 by Invista (Wichita, KS) can also, or alternatively, be used.

In certain embodiments, a water phase additive blend can further include certain components known for use in an additized oil phase. For example, certain couplers, chelating agents, and lubricity agents can be included in certain water phase additive blends including any of the couplers, chelating agents, and lubricity agents described as suitable for the additized oil phase. Generally, any known components of an additized oil phase can be suitable for a water phase additive blend if water soluble. As can be appreciated however, novel water-soluble compounds may provide similar, or improved, benefits to known oil phase additives.

Advantageously, the addition of a water phase additive blend does not increase the quantity of foam formed during use of an emulsion in certain embodiments. As can be appreciated, excessive foam formation during use of a metalworking fluid can cause issues with recirculation, pump cavitation, overflow, and misting. Additionally, foam is not pumped as efficiently as a fluid, so the amount of fluid can be decreased if foam reaches the pump intake. Since pumps generally reduce pressure to cause flow, the presence of bubbles can cause cavitation and increased wear on the pump. Popping of the foam bubbles can also generate small droplets that get suspended into the air. Such droplets can cause respiratory issues with operators.

Emulsion Stability

As can be appreciated, stable emulsions can be broken. For example, emulsions can be broken by increasing the salinity of the water, decreasing the pH, or by an increase in hard water cations (e.g., calcium ions). Once broken, an emulsion cannot be reformed and must be disposed of, the machines cleaned, and then new fluid made. During this process, production on the machines is suspended.

The performance of an emulsion, such as a metalworking fluid, can also degrade with time. For example, the loss of corrosion inhibition can render a metalworking fluid unsuitable for continued use. There is no practical means to restore this performance, and if "flash corrosion" suddenly occurs, the emulsion is usually replaced. Underperforming metalworking fluids can risk the generation of parts that would not be acceptable to the customer, the creation of hazards to the machinist, or the shortening of the tool life.

Metalworking fluids can also exhibit other failure modes including, for example, contamination and microbial attack. Contamination can include tramp oil, dirt, hard water increase, and part coatings. Microbes from the environment, either introduced through the air or the water used to make the fluid, can also damage the metalworking fluid. For physical contaminations, filtration, skimming and operator practice can prevent or reduce the effects of the contamination. However, there are no effective mechanisms to recover from hard water cation build-up or microbial contamination. Once the fluid reaches a certain point of degradation from the hard water or microbial attack, the fluid cannot be recovered.

As can be appreciated, the inclusion of a water phase additive blend including such components as an alkyl diphenyl oxide disulfonate can extend the life of an emulsion by enhancing an emulsions resistance to such failure modes.

Evaluative Tests

The Cast Iron Chip Test

Corrosion inhibition can be measured by the Cast Iron Chip Test. In the Cast Iron Chip Test, 2 mL of an emulsion are pipetted over 4 grams of cast iron chips which sit inside a 35×35 mm square on filter paper inside a petri dish. The petri dish is covered, and the chips are allowed to stand for 2 hours, after which the chips are rinsed from the filter paper and the filter paper inspected for staining. If three or fewer outlines of chips are visible on the filter paper after rinsing, then the emulsion passes the Cast Iron Chip Test. If more than three outlines of chips are visible on the filter paper after rinsing, then the emulsion fails the Cast Iron Chip Test.

The Visual Hard Water Cassia Flask Emulsion Stability Test

The Visual Hard Water Cassia Flask Emulsion Stability Test is carried out using the following procedure: Prepare an additized water phase by dissolving 1.2 grams of surfactant into 106.8 grams of deionized water containing 750 ppm $CaCO_3$. Blend 12.0 grams of a commercial soluble oil concentrate into 120 grams of the additized water phase. The mixture is stirred using a magnetic stir bar and a magnetic stir plate for at least 2 minutes at sufficient speed to create a vortex. Pour the emulsion into a Cassia flask and allow the emulsion to rest at ambient temperature (e.g., at about 23° C.) for 12 hours. Perform a visual inspection. If the emulsion separates significant cream (>0.3 mL), or separates into an oil and water phase, or if solids are detected by visual inspection then the emulsion fails the Visual Hard Water Cassia Flask Emulsion Stability Test. If the emulsion remained homogeneous (less than 0.3 mL of cream visible) by visual inspection then the emulsion passes the Visual Hard Water Cassia Flask Emulsion Stability Test.

The Turbiscan Droplet Size Determination

The Turbiscan Droplet Size Determination is carried out using the following procedure: Prepare an additized water phase by dissolving 1.2 grams of surfactant into 106.8 grams of deionized water containing 750 ppm CaCO3. Blend 12.0 grams of the commercial soluble oil concentrate into 120 grams of the additized water phase. The mixture is mixed using a magnetic stir bar for at least 2 minutes at a sufficient speed to create a vortex. Use the Turbiscan (Make: Turbiscan model: LAB) manufactured by Formulaction Inc. (Worthington, Ohio) to measure the oil drop size in the emulsion.

The Turbiscan Index

The Turbiscan (Make: Turbiscan model: LAB) can also be used to generate a stability index. When making repeated scans, an unstable emulsion will change the relative amounts of transmitted and backscattered light. The amount and speed of these changes can be used to generate the Turbiscan Stability Index. The Turbiscan Stability Index uses lower numbers to represent a more stable emulsion. Although the value is compared to the initial scan, an index of less than 1 indicates very good stability over that time period. An index exceeding about 5 indicates instability, and visual changes are likely to be seen in the future The Foaming Tendency Test The foaming tendency of an emulsion can be evaluated with the Foaming Tendency Test. For the Foaming Tendency Test, Oster's 16 speed Blender, Model #6817, is filled with 250 mL of the emulsion, then blended at the highest speed "frappe" for 60 seconds. The foam height is measured with a ruler on the outside of the blender vase at 1 minute and after 15 minutes. If the measurement at 15 minutes shows that the foam has diminished by more than 50%, then the emulsion passes the Foaming Tendency Test. If the measurement at 15 minutes shows that the foam has diminished by less than 50%, then the emulsion fails the Foaming Tendency Test.

The Tapping Torque Test

In the Tapping Torque Test, samples are run on a 1018 CRS standard steel block with thru holes drilled using an M5.55 (0.2185±0.001") reference drill diameter and measures the torque required to tap the holes with an M6 (6.0 mm) form tap. Before each sample is run, the tap is brushed clean and rinsed with isopropyl alcohol and hexane and each hole of the steel block is cleaned with a cotton swap, isopropyl alcohol and hexane. The tap and block are then rinsed with the sample to be tested. For each test, the bottom of the hole is taped and then the hole is filled with the sample to be tested. Each sample is tested in triplicate at a controlled temperature of 75° F. Values are reported in a percentage efficiency against a control fluid. The control fluid has a relative efficiency of 100%. Fluids with a higher relative efficiency provide better lubricity under the conditions tested.

EXAMPLES

A variety of metalworking fluid emulsions were prepared to evaluate the stability and benefits of including a water phase additive blend.

Corrosion Resistance

Examples 1 and 2 evaluate the improvement to corrosion inhibition caused by use of a water phase additive blend including a surfactant.

Example 1

Example 1 was an emulsion prepared by blending 12.0 grams of a commercial soluble oil concentrate, Trim Sol™ from Master Chemical Corp. (Perrysburg, Ohio) into 120 grams of deionized water. The commercial soluble oil concentrate was marked as being a suitable metalworking fluid for cutting and grinding. Upon mixing, Example 1 formed a stable emulsion that showed no creaming or oil separation after one week. The pH of the fluid was measured to be 9.0.

Example 2

Example 2 and was prepared by blending 12.0 grams of the commercial soluble oil concentrate of Example 1 into 120 grams of an additized water phase. The additized water phase was prepared by dissolving a water phase additive blend which included 1.2 grams of a blend of a blend of cocamide diethanolamine and diethanolamine oleate (Calamide® CWT by the Pilot Chemical Co. (Cincinnati, Ohio)) into 106.8 grams of deionized water.

Figure 4:
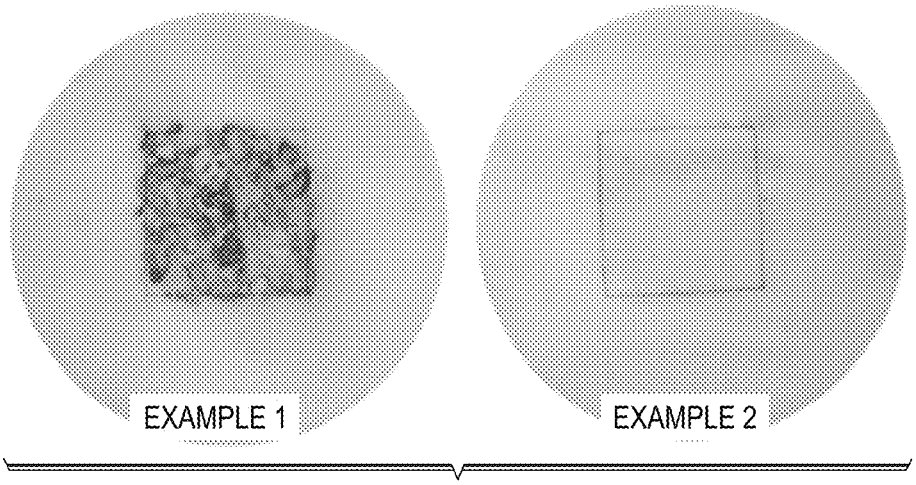
FIG. 4 depicts a photograph illustrating the results of a Cast Iron Chip Test evaluating the corrosion performance of Examples 1 and 2.

Example 1 and Example 2 were evaluated with the Cast Iron Chip test. Example 1 failed the Cast Iron Chip Test, while the emulsion of Example 2 passed the Cast Iron Chip Test as depicted in FIG. 4. Example 2 is considered inventive.

Hard Water Tolerance

Examples 3 to 6 evaluated the hard water stability of various emulsions. Specifically, each of Examples 3 to 6 was prepared in hard water having a concentration of calcium, as $CaCO_3$, of 750 ppm.

Example 3

Example 3 is similar to Example 1 but was formulated in the hard water.

Example 4

Example 4 evaluated whether the addition of an equimolar amount to calcium of a known hard water additive, ethylenediaminetetraacetic acid ("EDTA"), to Example 3 improved the stability. EDTA is a chelant which inhibits the effects of hard water when added in at least a stoichiometric amount to the calcium concentration.

Example 5

Example 5 was formed by modifying Example 3 through the addition of 5%, by weight, of hexadecyl diphenyl oxide disulfonate (Calfax® 16L-35 from the Pilot Chemical Co. (Cincinnati, Ohio). Hexadecyl diphenyl oxide disulfonate is a surfactant which interacts with calcium ions to increase hard water tolerance and can be added to the water prior to, or after, the formation of the emulsion in Example 3.

Example 6

Example 6 was formed by further modifying Example 5 to further include an equimolar amount to calcium of EDTA.

Each of Examples 3 to 6 were allowed to settle for three days and were then evaluated with the Visual Hard Water Cassia Flask Emulsion Stability Test.

Figure 5:
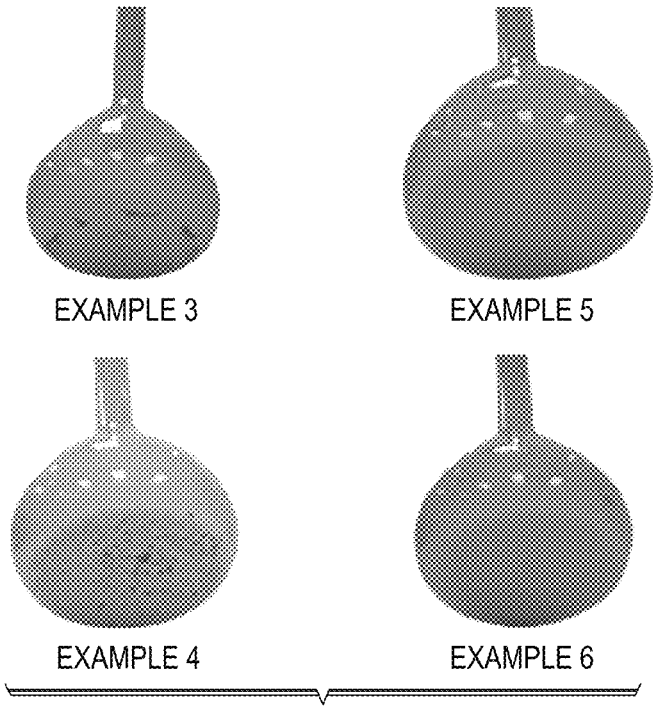
FIG. 5 depicts a photograph illustrating the results of a Visual Hard Water Cassia Flask Emulsion Stability Test evaluating the hard water stability of Examples 3 to 6.

Examples 3 and 4 were considered comparative because Example 3 deposited drops of oil while Example 4 exhibited significant oil separation. In contrast, Example 5 was considered inventive because it was stable and showed no signs of any deposition, even after several weeks. Comparatively, Example 4 exhibited more oil separation than Example 3. Example 6 was considered inventive but did have some white precipitate float. The Cassia flasks showing the results of the Visual Hard Water Cassia Flask Emulsion Stability Test are depicted in FIG. 5.

The stability of Examples 3 to 6 were further evaluated by generating a Turbiscan Stability Index. The Turbiscan Stability Index ("TSI") for each of Examples 3 to 6 was measured 4 days after formation of the emulsions. A TSI less than 1 indicates very little change in the emulsion. A TSI in excess of 4 indicates significant changes, even in the bulk emulsion.

The Visual Hard Water Cassia Flask Emulsion Stability Test results and Turbiscan Stability Index results for Examples 3 to 6 are depicted in Table 1.

TABLE 1

| Sample | Separation | TSI |
|---|---|---|
| Example 3 | Oil drops Settled | 11.5 |
| Example 4 | Oil drops settled, and floated | 0.93 |
| Example 5 | Stable | 12.0 |
| Example 6 | Stable, but some white ppt floated | 0.84 |

As indicated by Table 1, Examples 5 and 6 demonstrated that use of hexadecyl diphenyl oxide disulfonate surfactant in the water phase lead to the formation of stable emulsions which resisted high levels of dissolved calcium. Conversely, Examples 3 and 4, free of the water phase surfactant, were not stable even when a hard water stabilizing chelant, EDTA, was included.

Examples 7 to 9

Hard water tolerance was further measured using an alternative emulsifier package including natural petroleum sulfonate, potassium tall oil fatty acid salts, triethanolamine, diethylene glycol, and hexylene glycol (commercially sold as Petromix® #9 by Sea-Land Chemical Co. (Westlake, Ohio)). The emulsifier package was diluted with oil in a ratio of 12.5 grams emulsifier package to 50 grams oil. Examples 7 to 9 were then formed by mixing the oil mixture with 140 grams of water including varying amounts of hexadecyl diphenyl oxide disulfonate. Example 7 included no hexadecyl diphenyl oxide disulfonate in the water (0% alkyl diphenyl oxide disulfonate). Example 8 included 1.4 grams of hexadecyl diphenyl oxide disulfonate (Calfax® 16L-35) dissolved in the water (0.35% alkyl diphenyl oxide disulfonate). Example 9 included 2.8 grams of hexadecyl diphenyl oxide disulfonate (Calfax® 16L-35) dissolved in the water (0.70% alkyl diphenyl oxide disulfonate).

Examples 7 to 9 were transferred into Cassia flasks and evaluated with the Visual Hard Water Cassia Flask Emulsion Stability Test. The results of the Visual Hard Water Cassia Flask Emulsion Stability Test for Examples 7 to 9 are depicted in FIG. 6.

Figure 6:
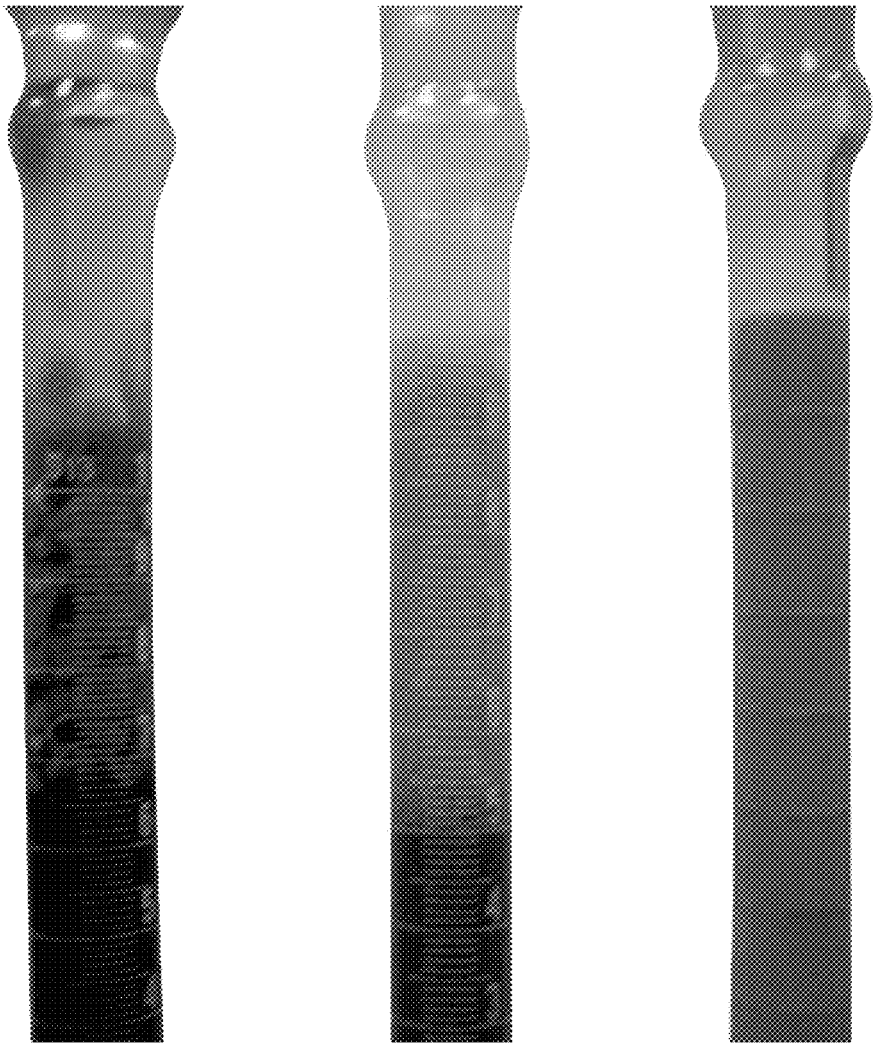
FIG. 6 depicts a photograph illustrating the results of a Visual Hard Water Cassia Flask Emulsion Stability Test evaluating the hard water stability of Examples 7 to 9.

As shown in FIG. 6, Example 9, including 0.70% hexadecyl diphenyl oxide disulfonate, formed a uniform emulsion with about 0.1 mL cream separation and raised the stability of the emulsion to 1,000 ppm water. Accordingly, Example 9 is considered inventive.

Foam

Examples 10 and 11 were prepared to evaluate the foam stability of emulsions formed with and without hexadecyl diphenyl oxide disulfonate. Examples 10 and 11 are similar to Examples 3 and 5 but formed in deionized water rather than hard water. Specifically, Example 10 included 25.0 grams of the commercial soluble oil concentrate of Example 1 in 250 grams of deionized water. Example 11 included 25.0 grams of the commercial soluble oil concentrate of Example 1 and a water phase additive blend formed of 25.0 grams of hexadecyl diphenyl oxide disulfonate (Calfax® 16L-35) and 225.0 grams of deionized water.

Each of Examples 10 and 11 were evaluated using the Foaming Tendency Test. Each Example emulsion was blended at the highest speed for one minute, than the foam height measured when the blender was stopped, and again at 1, and 5 minutes later. The results are depicted in Table 2.

TABLE 2

| Time Minutes | Example 10 Liquid/Total (Foam) in mm | Example 11 Liquid/Total (Foam) in mm |
|---|---|---|
| Initial | 0/86 (86) | 0/85 (85) |
| 1 | 0/72 (72) | 0/73 (73) |
| 5 | 21/48 (27) | 22/40 (18) |
| 10 | 23/40 (17) | 25/32 (7) |
| 15 | 24/37 (13) | 26/31 (5) |
| Decay 10-15 minutes | 23.5% | 28.6% |

As indicated by Table 2, Example 11 formed less foam than Example 10 and is considered inventive. Additionally, the foam that formed for Example 11 decayed faster than the foam of Example 10.

Addition of Water Phase Surfactant

Examples 12 and 13 were formed to evaluate the stability of an emulsion when the water phase surfactant was added to the water either before the formation of the emulsion, or after formation of the emulsion.

Example 12 evaluated whether the water phase surfactant could be added to water prior to mixing with the oil phase. In Example 12, an emulsion was prepared by blending 12.0 grams of the commercial soluble oil concentrate of Example 1 into 108 grams of deionized water previously mixed with 12.0 grams of hexadecyl diphenyl oxide disulfonate (Calfax® 16L-35). Upon mixing, Example 12 formed a stable emulsion that showed no creaming or oil separation after one week.

Example 13 was prepared by blending 12.0 grams of the commercial soluble oil concentrate of Example 1 into 108 grams of deionized water. Upon mixing, this formed a stable emulsion. To this emulsion, 12.0 grams of hexadecyl diphenyl oxide disulfonate (Calfax® 16L-35) was added to form Example 13. Example 13 remained stable for more than a week with no visible separation.

As indicated by Examples 12 and 13, a water phase surfactant can be added either before the formation of the emulsion or after the formation of the emulsion.

Lubricity

Examples 14 to 18 evaluated the effect on lubricity caused by the addition of water phase surfactants and water phase lubricants using the Tapping Torque Test. The relative efficiency and torque measurements are reported in Table 3. Example 14 was used as the control for the relative efficiency of each of the Examples.

Example 14 was prepared by blending the commercial soluble oil concentrate of Example 1 into deionized water at a ratio of 5 grams per 100 grams of water. Example 15 was prepared by blending 0.7%, by weight, of a 2% solution of hexadecyl diphenyl oxide disulfonate (0.7% active) (Calfax® 16L-35) in water into Example 14. Example 16 was prepared by blending 1%, by weight, of a 2% solution of a water-soluble lubricity agent, cocamide diethanolamide (Calamide® C by the Pilot Chemical Co. (Cincinnati, Ohio)) in water into Example 15. Example 17 was prepared by blending 1%, by weight, of a 2% solution of a water-soluble lubricity agent, back-titrated coconut diethanolamide (Calamide® CWT) in water into Example 15. Example 18 did not include a water phase surfactant and was prepared by blending 1%, by weight, of a 2% solution of back-titrated coconut diethanolamide (Calamide® CWT) into Example 14.

TABLE 3

| Example | Torque Measurement 1 (N * cm) | Torque Measurement 2 (N * cm) | Torque Measurement 3 (N * cm) | Avg. Torque Measurement (N * cm) | Relative Efficiency (%) |
|---|---|---|---|---|---|
| 14 | 185 | 187 | 186 | 186 | 100.0 |
| 15 | 183 | 178 | 181 | 181 | 100.2 |
| 16 | 180 | 177 | 181 | 179 | 105.9 |
| 17 | 176 | 176 | 178 | 177 | 108.7 |
| 18 | 180 | 188 | 186 | 185 | 102.3 |

As depicted in Table 3, the inclusion of a water phase additive blend including an anionic surfactant did not appear to impact the lubricity performance. For example, Examples 14 and 15 exhibited similar lubricity performance despite Example 15 including hexadecyl diphenyl oxide disulfonate at a loading level high enough to increase tolerance of calcium ion contamination from 400 ppm to 1000 ppm. Additionally, Examples 16 to 18 demonstrate that the addition of a water-phase additive blend can improve the machining performance of a metalworking fluid.

Biological Effects

Examples 19 and 20 were prepared to evaluate the impact of water phase additive blends on biological contamination of a metalworking fluid. Examples 19 and 20 were prepared through the addition of a quaternary ammonium additive to Examples 7 and 9 respectively. The quaternary ammonium compound was added at a rate of 2 mL per liter. The quaternary ammonium additive was a 50% active 50:50 blend of alkyl dimethyl benzyl ammonium chloride with an alkyl distribution of 10% C16, 50% C14, and 40% C12, and an alkyl dimethyl ethyl benzene ammonium chloride with an alkyl distribution of 68% C12 and 32% C14 (commercially available as Mason® CS-EBC-50 from the Pilot Chemical Co. of Cincinnati, Ohio). The quaternary ammonium compound was free of organic solvent.

Examples 19 and 20 were evaluated in accordance to ASTM Practice E2275 (Standard Practice for Evaluating Water-Miscible Metalworking Fluid Bioresistance and Antimicrobial Pesticide Performance). ASTM Practice E2275 evaluates a metalworking fluid's biological performance using a 120 hour speed of kill test. For the speed of kill test, Examples 19 and 20 were diluted with deionized water to 5% v/v and challenged with 2 mL of a control metalworking fluid including 6.46 $Log_{10}$ colony forming units ("CFU") per mL of an uncharacterized, bacterial mixed-population. Table 4 depicts the reduction of colony forming units of Examples 12 and 13 compared to the control metalworking fluid.

TABLE 4

| | Elapsed Hours | | | | |
|---|---|---|---|---|---|
| | 4 | 8 | 24 | 72 | 120 |
| Example 19 ($Log_{10}$ CFU per mL) | 0.00 | 0.00 | 0.12 | 0.05 | 0.03 |
| Example 20 ($Log_{10}$ CFU per mL) | 0.43 | 0.13 | 0.60 | 2.50 | 2.30 |

As depicted by Table 4, the addition of a quaternary ammonium additive alone did not have a statistically significant effect on biological growth as seen in Example 19 but also did not accelerate biological growth. Conversely, the addition of the quaternary ammonium additive in combination with hexadecyl diphenyl oxide disulfonate (0.7%) as seen in Example 20 demonstrates that a combination of a quaternary ammonium additive with alkyl diphenyl oxide disulfonate can exhibit a synergistic improvement in the reduction of biological activity.

Reversibility of Emulsion Formation

Examples 21 to 24 were prepared to evaluate whether an emulsion could be changed after formation. Examples 21 to 23 were emulsions prepared with deionized water, and water with 250 or 500 ppm respectively of $CaCO_3$. Example 24 was a 50:50 blend of Examples 21 and 23. The droplet sizes of each of Examples 21 to 24 were measured in accordance to the Turbiscan Droplet Size Determination. A graph depicting the droplet size over time of Examples 21 to 24 is depicted in FIG. 7.

Figure 7:
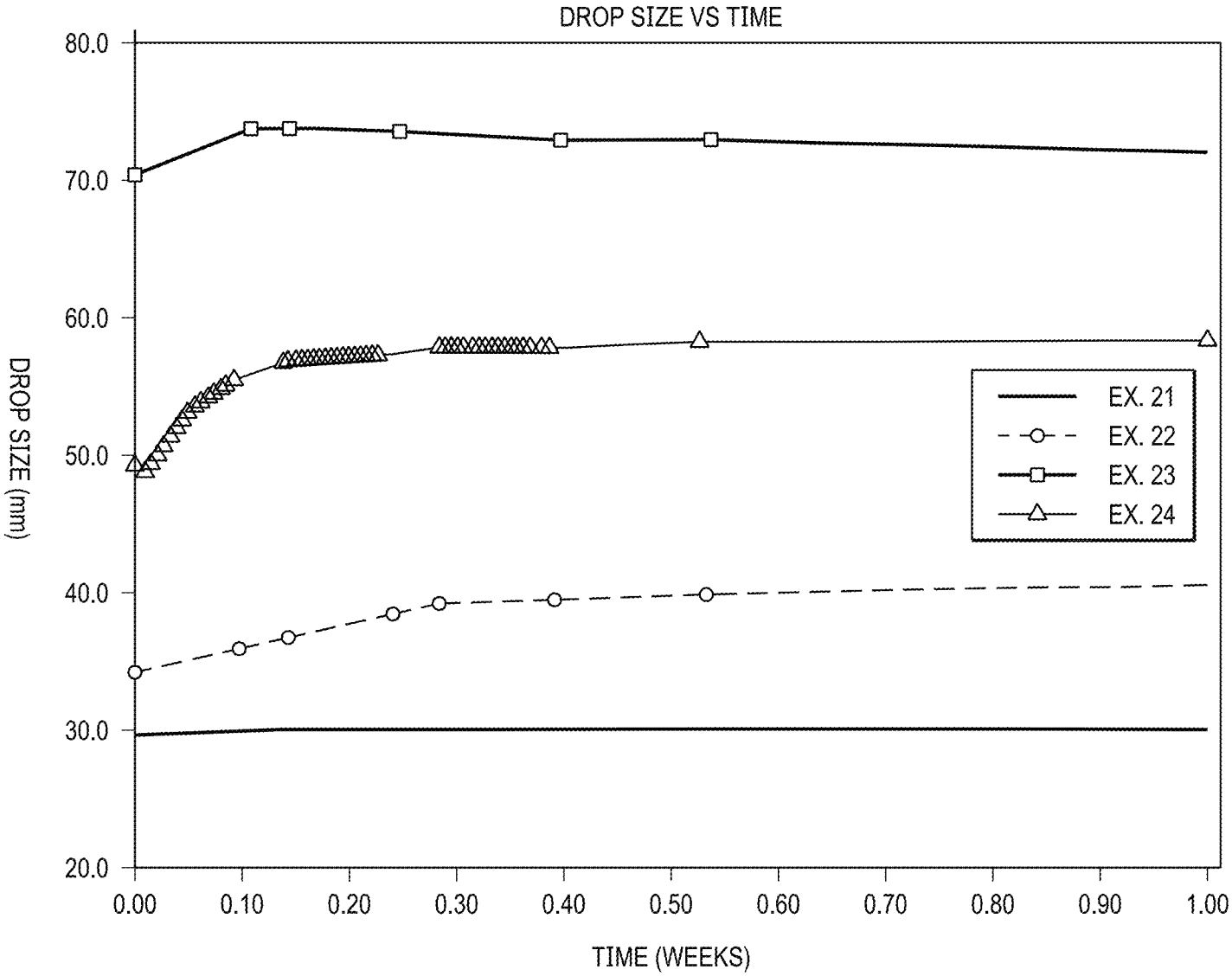
FIG. 7 depicts a graph illustrating the droplet size of Examples 21 to 24.

As depicted by FIG. 7, Example 24 does not initially match the droplet size, or equilibrate to match the droplet size of Example 22 despite having the same final concentration of 250 ppm $CaCO_3$. Examples 21 to 24 support the conclusion that multivalent cation contamination is irreversible.

As used herein, all percentages (%) are percent by dry weight of the total composition, also expressed as weight/weight %, % (w/w), w/w, w/w % or simply %, unless otherwise indicated. Also, as used herein, the terms "wet" refers to relative percentages of the coating composition in a dispersion medium (e.g. water); and "dry" refers to the relative percentages of the dry coating composition prior to the addition of the dispersion medium. In other words, the dry percentages are those present without taking the dispersion medium into account. Wet admixture refers to the coating composition with the dispersion medium added. "Wet weight percentage", or the like, is the weight in a wet mixture; and "dry weight percentage", or the like, is the weight percentage in a dry composition without the dispersion medium. Unless otherwise indicated, percentages (%) used herein are dry weight percentages based on the weight of the total composition.

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. An emulsion comprising:

an additized oil phase comprising oil and one or more oil phase surfactants; and a water phase additive blend comprising one or more water phase components, the water phase components comprising:

a surfactant;

a corrosion resistance agent;

a lubricity agent; and a biological regulating agent.

2. The emulsion of claim 1, wherein the oil phase components and the water phase components are incompatible in a single phase.

3. The emulsion of claim 1, wherein the surfactant comprises one or more anionic surfactants, cationic surfactants, betaine-type amphoteric surfactants, and non-ionic surfactants.

4. The emulsion of claim 3, wherein the anionic surfactant comprises one or more amine, alkali metal, or alkaline earth metal salts of: C6-C24 alkyl diphenyl oxide disulfonates, C8-C24 alkyl ether sulfates, C8-C24 alkyl sulfates, C8-C16 alkyl aromatic sulfonates, C10-C18 olefin sulfonates, C8-C24 carboxylates, C8-C24 phosphate mono and/or di-esters, sulfo-succinate mono or di-esters of C8-C24 linear or branched alcohols, and alcohol ethoxylates.

5. The emulsion of claim 3, wherein the cationic surfactant comprises one or more quaternary ammonium surfactants; and wherein the biological regulating agent comprises the cationic surfactant.

6. The emulsion of claim 1, wherein the corrosion resistance agent comprises one or more of an amine carboxylate, amine or alkali metal salts of decyl dicarboxylic acid, amine or alkali metal salts of undecyl dicarboxylic acid, amine or alkali metal salts of azelic acid, amine borate esters, amine or alkali metal succinate esters, sodium nitrite, and ethoxylated amines.

7. The emulsion of claim 1, wherein the lubricity agent comprises one or more of C8-C20 alkyl amides or alkanolamides, cocamide di-isopropanol amide ("DIPA"), cocamide diethanolamide, C8-C24 alkyl phosphate esters, C8-C20 linear or branched carboxylates polyol esters, and carboxylate esters.

8. The emulsion of claim 1, wherein the water phase components comprise anionic surfactants and cationic surfactants; and wherein the anionic surfactants and cationic surfactants are included in a molar ratio of about 1 to about 10, or more cationic surfactant to anionic surfactant.

9. The emulsion of claim 1, wherein the water phase components comprise an alkyl diphenyl oxide disulfonate.

10. The emulsion of claim 1, wherein the water phase components comprise anionic surfactants and the emulsion passes the Visual Hard Water *Cassia* Emulsion Stability Test at concentrations of about 1,000 parts-per-million ("ppm") or more, multivalent cations.

11. The emulsion of claim 1, wherein the water phase components comprise an anionic surfactant and the corrosion resistance agent and wherein the emulsion passes the Cast Iron Chip Test.

12. The emulsion of claim 11, wherein the additized oil phase is substantially free of amines and amides.

13. The emulsion of claim 1, wherein the water phase components comprise an anionic surfactant and the lubricity agent, and wherein the emulsion exhibits greater efficiency on the Tapping Torque Test than a similar emulsion formed without the water phase components.

14. The emulsion of claim 1, wherein the water phase components comprise an anionic surfactant and the biological regulating agent; and wherein the emulsion exhibits a greater reduction of colony forming units ("CFU") after 24 hours when compared to a similar emulsion formed without the water phase components when tested in accordance to ASTM Practice E2275.

15. The emulsion of claim 1, wherein the additized oil phase further comprises one or more of a secondary emulsifier, a coupler, an alkalinity agent, an oil-phase corrosion inhibition agent, an oil-phase lubricity agent, and an anti-wear performance additive.

16. The emulsion of claim 1, wherein the additized oil phase is substantially free of any chelating agents.

17. The emulsion of claim 1 is a metalworking fluid.

18. A method of improving an emulsion comprising:

adding a water phase additive blend to an emulsion comprising water and an additized oil phase; and wherein the water phase additive blend comprises one or more water phase components, the water phase components comprising:

a surfactant;

a corrosion resistance agent;

a lubricity agent; and a biological regulating agent.

19. A method of forming emulsion comprising:

adding an additized water phase to an additized oil phase; and wherein the additized water phase comprises one or more water phase components, the water phase components comprising:

a surfactant;

a corrosion resistance agent;

a lubricity agent; and a biological regulating agent.

* * * * *